US007165999B1

(12) United States Patent
Liao

(10) Patent No.: US 7,165,999 B1
(45) Date of Patent: Jan. 23, 2007

(54) FASTENING STRUCTURE FOR ELECTRICAL CONNECTOR

(75) Inventor: Chun-Ying Liao, Taoyuan (TW)

(73) Assignee: Speed Tech Corp., Taoyuan County (TW)

( * ) Notice: Subject to any disclaimer, the term of this patent is extended or adjusted under 35 U.S.C. 154(b) by 0 days.

(21) Appl. No.: 11/432,552

(22) Filed: May 12, 2006

(51) Int. Cl.
*H01R 24/04* (2006.01)

(52) U.S. Cl. ..... 439/668; 439/686

(58) Field of Classification Search ..... 439/668, 439/669, 634, 686, 687, 688, 689
See application file for complete search history.

(56) References Cited

U.S. PATENT DOCUMENTS 5,249,987 A * 10/1993 Kristiansen ..... 439/676
6,000,970 A * 12/1999 Wu ..... 439/669
6,220,898 B1 * 4/2001 Wu ..... 439/668

FOREIGN PATENT DOCUMENTS

GB 2112589 A * 7/1983

* cited by examiner

*Primary Examiner*—Hae Moon Hyeon
(74) *Attorney, Agent, or Firm*—Troxell Law Office, PLLC

(57) ABSTRACT

The present invention firmly fastens a cover and a base of an electrical connector. The fastening is done with a precise three-dimensional positioning. The process for a mold opening of the connector is simplified and no slider is in need.

5 Claims, 7 Drawing Sheets

FASTENING STRUCTURE FOR ELECTRICAL CONNECTOR

FIELD OF THE INVENTION

The present invention relates to a fastening structure; more particularly, relates to firmly fastening a base member and a cover member by a precise three-dimensional positioning while leaving out slider with a simplified mold opening.

DESCRIPTION OF THE RELATED ART

As shown in FIG. 6, a prior art is proclaimed in Taiwan, called "An assembly of a connector", comprising an insulated base 4, a main frame 5 and a terminals seat 6. Therein, the insulated base 4 has a connecting space 41 and a first connecting part 42; the first connecting part 42 has two first locking holes 421 at two sides separately; a plurality of long sags 411 are concaved at the bottom of the connecting space 41; the connecting space 41 is led to the first connecting part 42 at the back of the insulated base 4. The main frame 5 is bond to the first connecting part 42 of the insulated base 4; the main frame 5 has a containing space 51 inside; the containing space 51 has a second connecting part 52 at a side; the second connecting part 52 has two first lockers 521 at two sides to be locked with the first locking holes 421 for fastening to the first connecting part 42 of the insulated base 4; and, the main frame 5 has a second locker 71 at the bottom. The terminals seat 6 is bond to the first connecting part 42 of the insulated base 4 and is located at the bottom of the main frame 5; the terminals seat 6 has an connecting space 61; the terminals seat 6 has a second locking hole 72 corresponding to the second locker 71 at the bottom of the main frame 5 for fastening. to the main frame 5. The connector of the prior art is obtained by locking the second locker 71 of the main frame 5 to the second locking hole 72 of the terminals seat and then butting and binding the first locker 521 of the second connecting part 521 to the first locking hole 421 of the first connecting part 42.

Yet, the insulated base 4, the ma in frame 5 and the terminals seat 6 are bond by locking and butting the first locker 521, the first locking hole 421, the second locker 71, and the second locking hole 72 so that its fastening force and its stability is not strong enough. Besides, the first locker 521 and the second locker 71 are extended outwardly, which is apt to be broken on assembling the prior art. Hence, the prior art does not fulfill users' requests on actual use.

SUMMARY OF THE INVENTION

The main purpose of the present invention is to firmly fasten a base member and a cover member through binding a combining part and a gap of a base member to an indentation part and a socket part of a cover member respectively by a precise three-dimensional positioning.

Another purpose of the present invention is to simplify a mold opening while leaving out slider.

To achieve the above purposes, the present invention is a fastening structure for an electrical connector, comprising a base member and a cover member. Therein, the base member has a containing space and a socket unit; the socket unit is exposed out of an end surface of the base member; the containing space has a plurality of conductive terminals; at least two corresponding combining parts are set at a rim of an opening end of the containing space; and, the containing space has two gaps on two side surfaces leading to the bottom of the base member. The cover member comprises a cover plate and a bottom plate; the cover plate is cove red on the opening end of the containing space; the bottom plate is deposed at the bottom of the base member penetrated through by the conductive terminals; the cover plate has an indentation part corresponding to the combining part of the base member; and, the bottom plate has a socket part locked to the gap of the base member. Accordingly, a novel fastening structure for an electrical connector with no slider is obtained while a mold opening is simplified.

BRIEF DESCRIPTIONS OF THE DRAWINGS

The present invention will be better understood from the following detailed description of the preferred embodiment according to the present invention, taken in conjunction with the accompanying drawings, in which FIG. 1 is a perspective view of a preferred embodiment according to the present invention;

DESCRIPTION OF THE PREFERRED EMBODIMENT

The following description of the preferred embodiment is provided to understand the features and the structures of the present invention.

Figure 1:
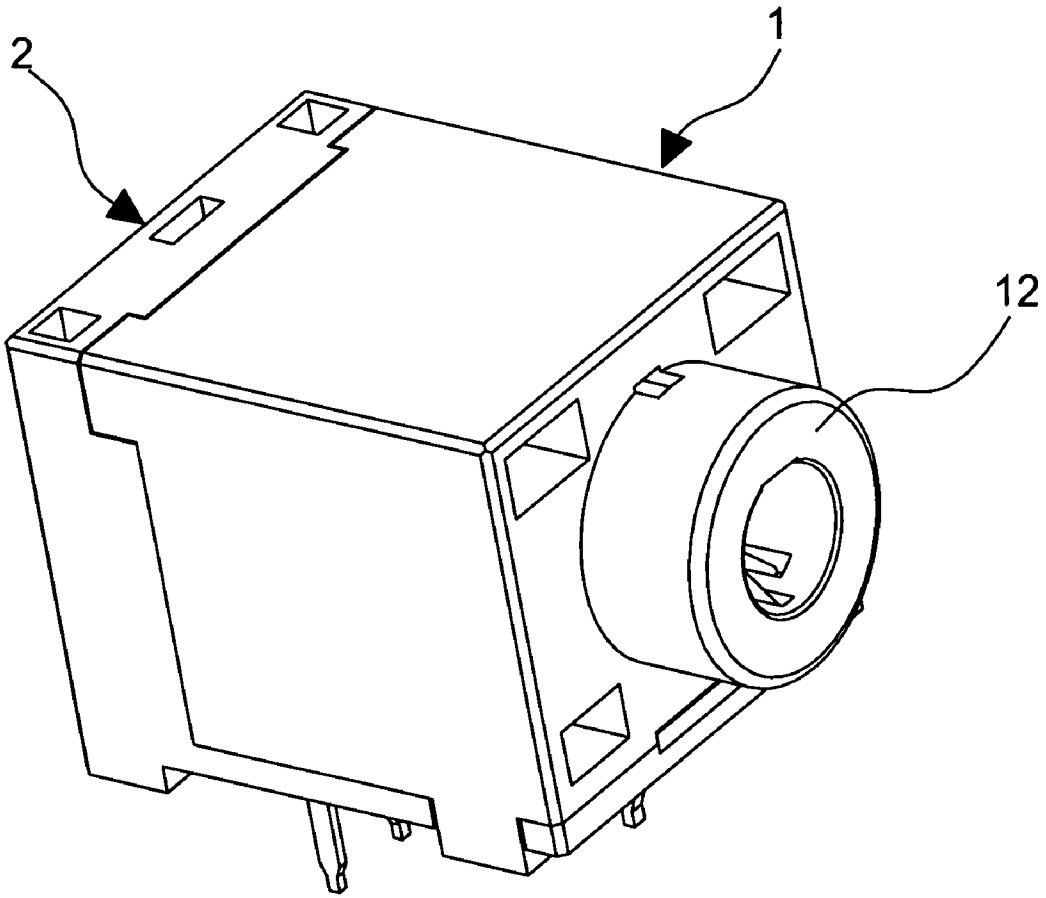

Please refer to FIG. 1, which is a perspective view of a preferred embodiment according to the present invention. As shown in the figure, the present invention is a fastening structure for an electrical connector, comprising a base member 1 and a cover member 2, where, after fastening the base member 1 and the cover member 2, the electrical connector is firmly constructed with a precise three-dimensional positioning while leaving out slider and a mold opening is simplified.

Figure 2:
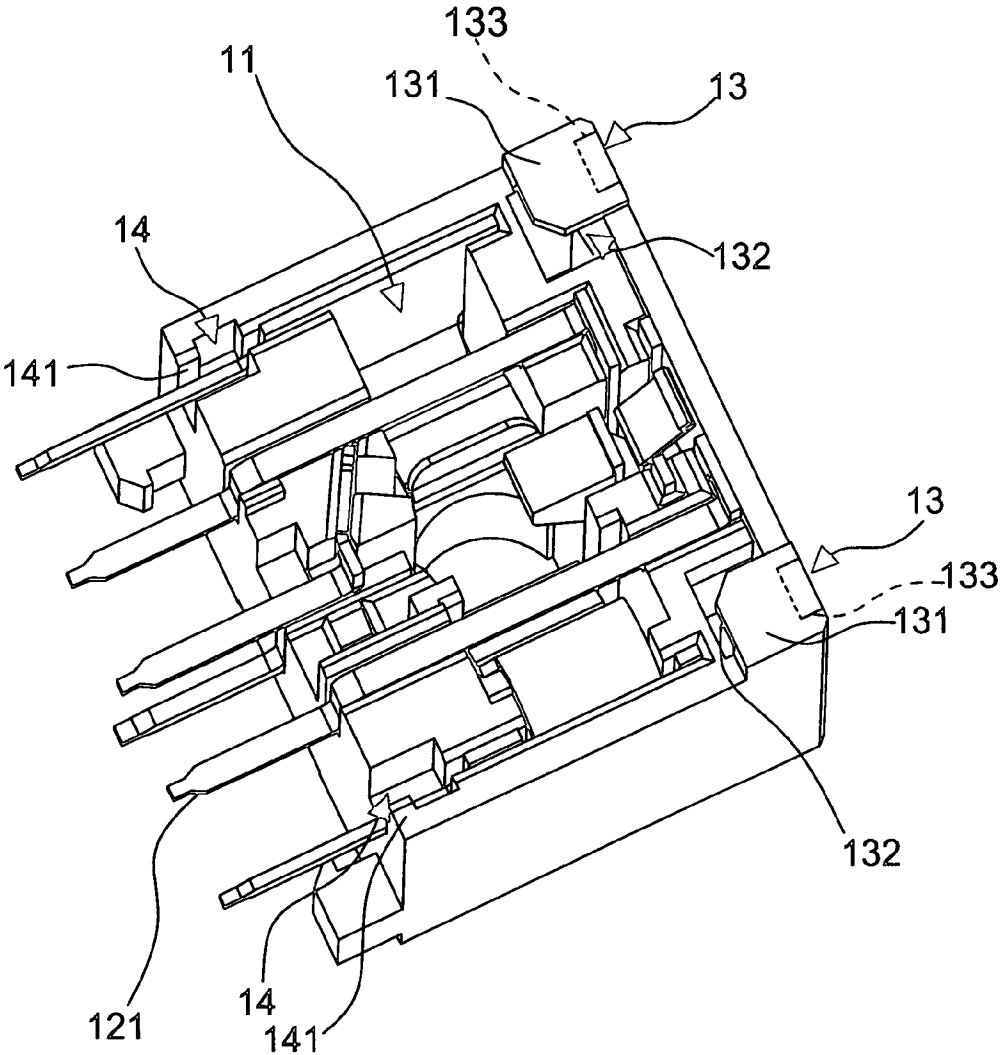
FIG. 2 is a perspective view of the base member.

Please further refer to FIG. 2, which is a perspective view of the base member. As shown in the figure, the base member 1 has a containing space 11 and a socket unit 12; a plurality of conductive terminals 121 are deposed in the containing space 11; the socket unit 121 extends out of an end surface of the base member 1; the conductive terminals 121 extend out of the bottom of the base member 1; at least two combining parts 13 are set at a rim of an opening end of the containing space 11; the combining part 13 has a baffle plate 131; a slot 132 is formed between the baffle plate 131 and an end surface of the base member 1; the baffle plate 131 has a protrusion 133 on a surface corresponding to the end surface of the base member 1; the containing space 11 has two gaps 14 at two sides of the opening end; the gaps 14 are led to the bottom of the base member 1; and, each gap 14 has a protruding part 141 on a side surface at bottom.

Figure 3:
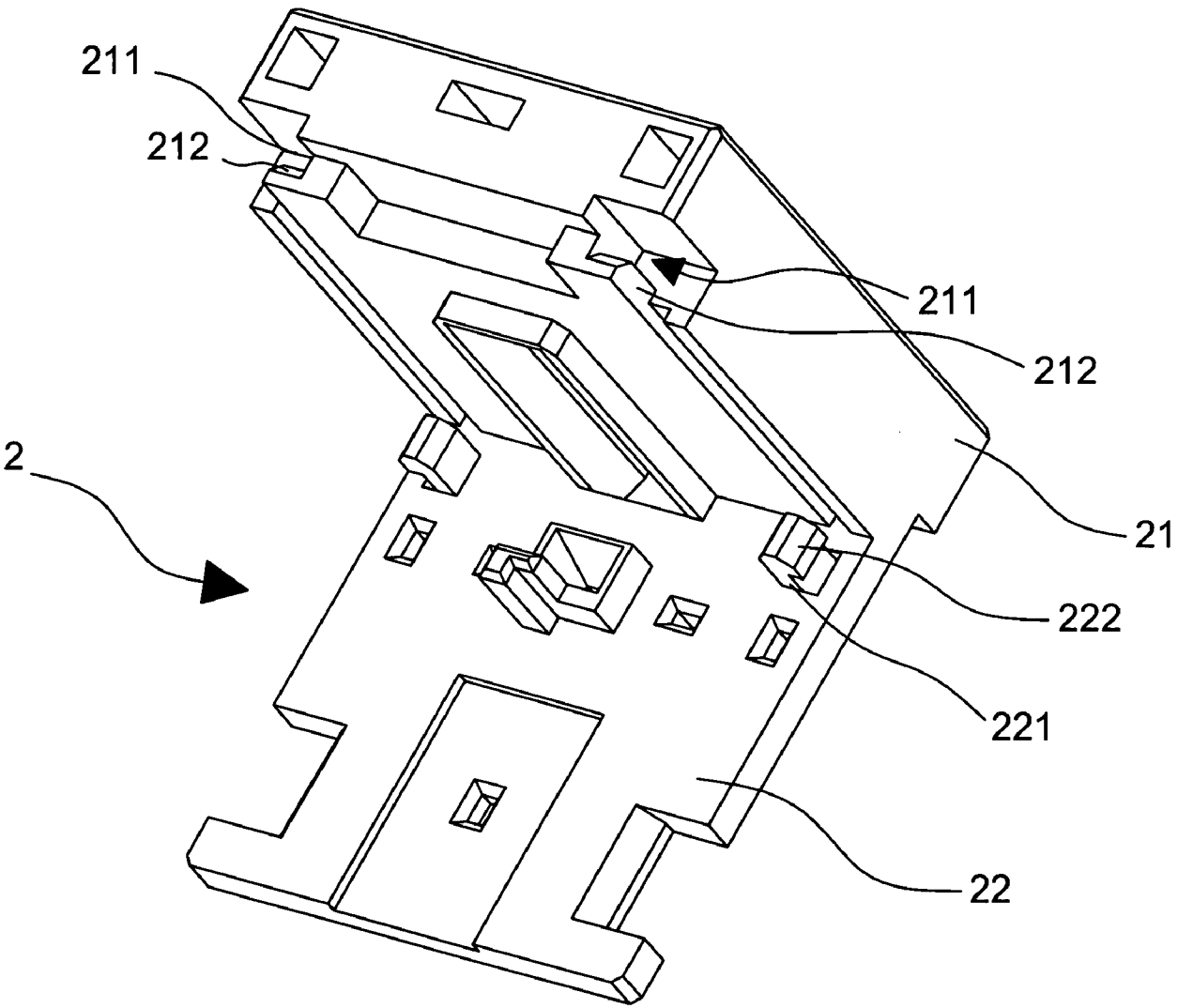
FIG. 3 is a perspective view of the cover member.

Please further refer to FIG. 3, which is a perspective view of the cover member. As shown in the figure, a cover member 2 according to the present invention comprises a cover plate 21 and a bottom plate 22, where the cover plate 21 is covered on an opening end of a containing space 11; the bottom plate 22 is located at the bottom of the base member 1 and is connected with the cover plate 21; and, a plurality of conductive terminal 121 is penetrated through the bottom plate 22. An indentation part 211 is deposed at the rim of the cover plate 21 corresponding to the combining part 13 of the base member 1 to be fastened together; and, a protrusion 212 is deposed on a surface of the indentation part 211. The bottom plate 22 has a socket part 221 to be fastened to the gap 14 at the bottom of the base member 1; and the socket part 221 has a hook 222. Thus, with the above structure, a novel fastening structure for an electrical connector is obtained.

Figure 4:
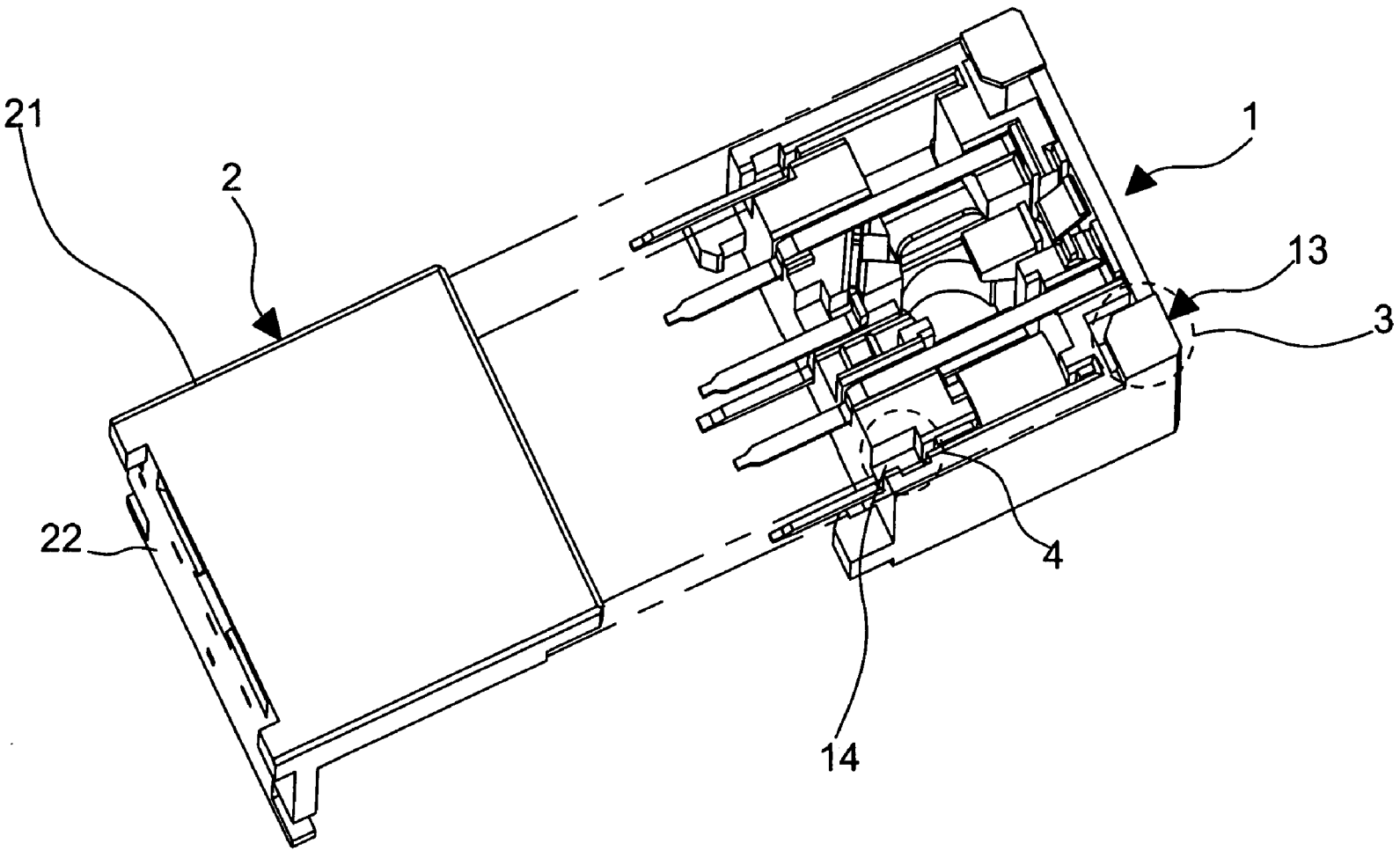
FIG. 4 is a view showing an assembly of the preferred embodiment.
Figure 5A:
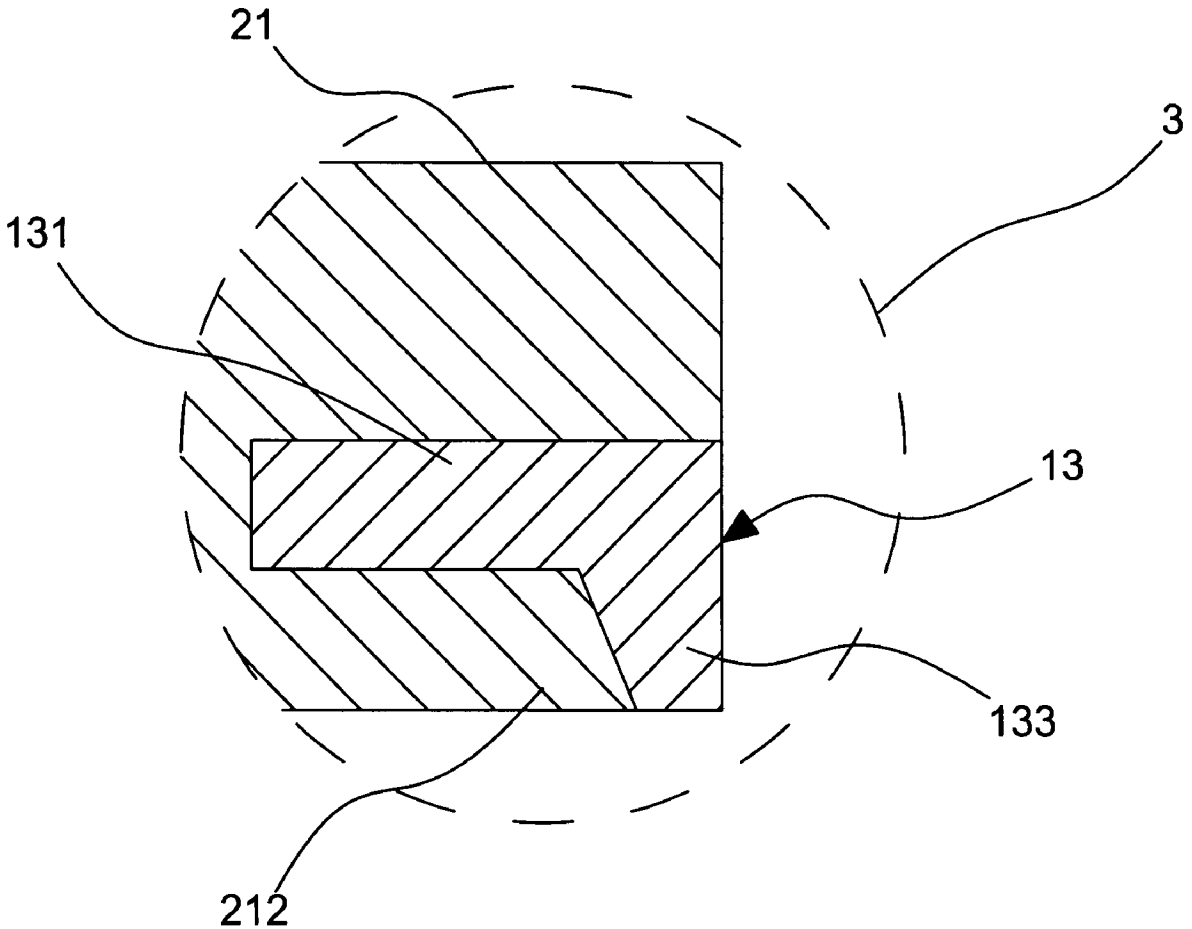
FIG. 5A is a first partial cross-sectional view of the assembly.
Figure 5B:
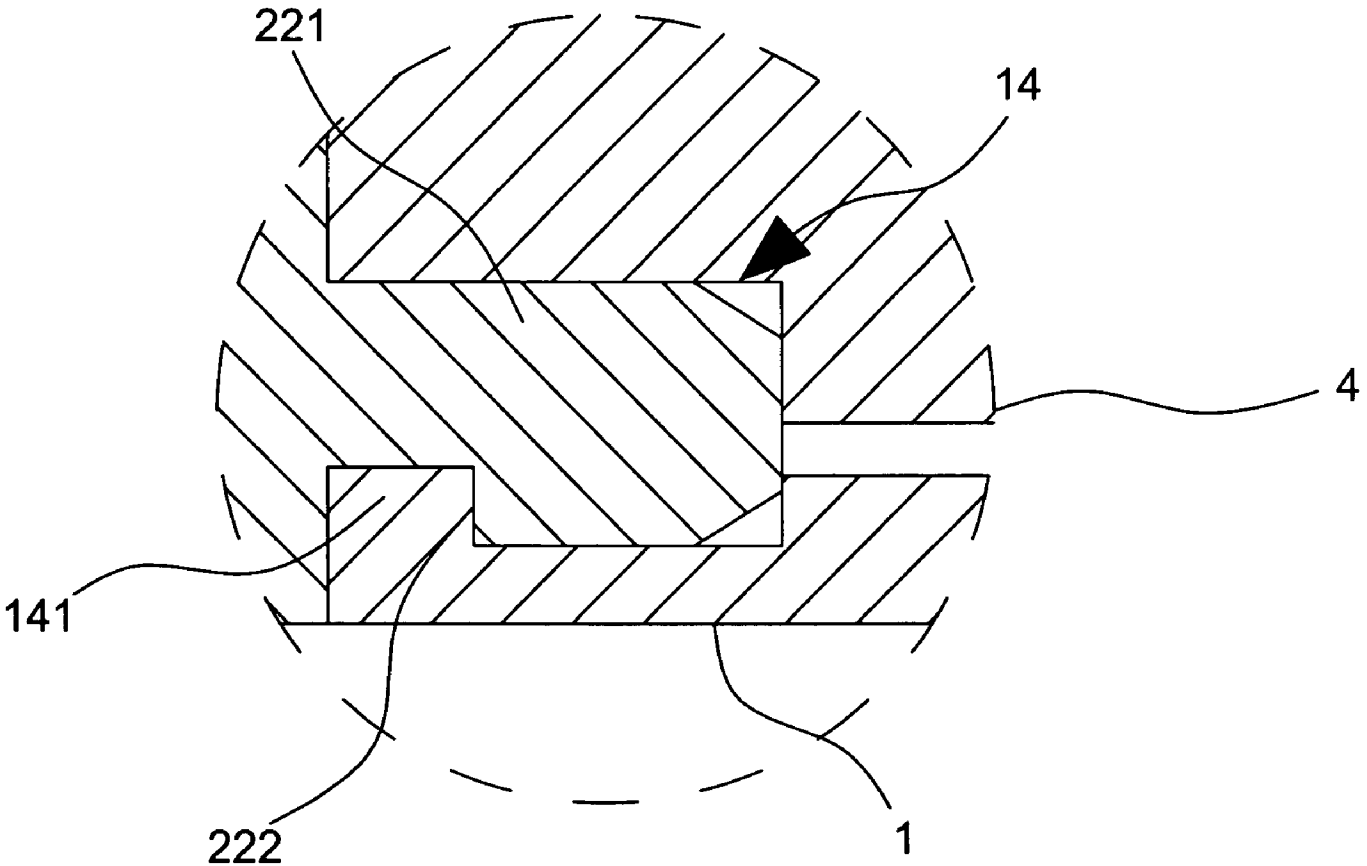
FIG. 5B is a second partial cross-sectional view of the assembly.
Figure 6:
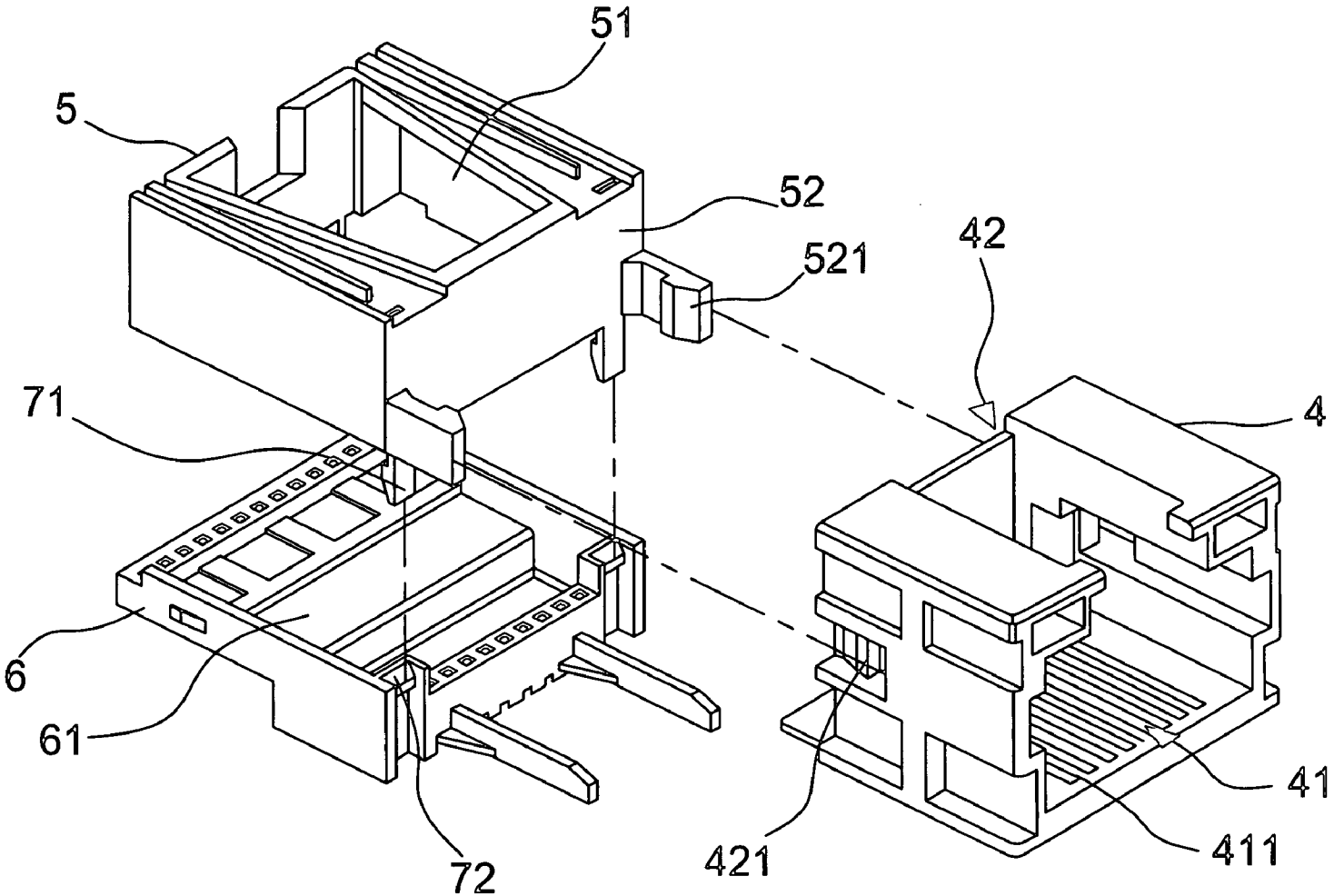
FIG.6 (Prior art)
FIG. 6 is a structural view of a prior art.

Please refer to FIG. 4, FIG. 5A and FIG. 5B, which are a view showing an assembly of the preferred embodiment, and a first 3 and a second 4 partial cross-sectional views of the assembly. As shown in the figures, when assembling a base member 1 and a cover member 2 according to the present invention, the cover member 2 is moved to be locked to the base member 1. After the assembly, an indentation part 211 (please refer to FIG. 3) at an end of the cover plate 21 is corresponding to a combining part 13 of the base member 1, as shown in the first partial cross-sectional view 3, where, through a protrusion 133 of the combining part 13, a baffle plate 131 of the combining part 13 is butted at a side of a protrusion 212 of the indentation part 211; and a side of the combining part 13 is closely stuck to a side of the indentation part 211. Hence, the base member 1 and the cover member 2 are precisely positioned in the directions of X-axis and Y-axis when being fastened together, as shown by FIG. 5A. in the other hand, as shown in the second partial cross-sectional view 4, a socket part 221 of the bottom plate 22 is inserted into a gap 14 of the base member 1 so that a hook 222 of the socket part 221 is locked with a protruding part 141 at a side of the gap 14. Hence, the base member 1 and the cover member 2 are fastened together with a precise positioning in the direction of Z-axis, as shown by FIG. 5B. Consequently, the base member 1 and the cover member 2 are firmly fastened together by being precisely positioned in the directions of X-axis, Y-axis and Z-axis.

To sum up, the present invention is a fastening structure for an electrical connector, where a base member and a cover member are firmly fastened together through binding a combining part and a gap of the base member to an indentation part and a socket part of the cover member respectively by a precise three-dimensional positioning while leaving out slider and a mold opening is simplified.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A fastening structure for an electrical connector, comprising:

a base member, said base member having a containing space and a socket unit, said containing space having a plurality of conductive terminals, said conductive terminals being extended out of a bottom of said base member, at least two corresponding combining parts being set on a rim of an opening end of said containing space, two gaps being deposed at two sides of said opening end of said containing space separately, said socket unit being exposed at a side of said base member; and a cover member, said cover member comprising a cover plate and a bottom plate, said cover plate being covered at said opening end of said containing space, said bottom plate being fastened with said cover plate, said bottom plate being penetrated by said conductive terminals, said cover plate having an indentation part at a rim of said cover plate, said cover plate being connected with said combining part of said base member correspondingly, said bottom plate having a socket part, said socket part being locked to said gap on a bottom of said base member.

2. The fastening structure according to claim 1, where in said combining part has a baffle plate at a border of said opening end of said containing space;

wherein a slot is obtained between said baffle plate and said base member; and wherein said baffle plate has a protrusion on a surface corresponding to said base member.

3. The fastening structure according to claim 1, wherein a protruding part is deposed on a rim at a side of a bottom of said gap.

4. The fastening structure according to claim 1, wherein a protrusion is deposed on a surface of said indentation part.

5. The fastening structure according to claim 1, wherein said socket part has a hook.

* * * * *